US009188938B2

(12) United States Patent
Ushikubo

(10) Patent No.: US 9,188,938 B2
(45) Date of Patent: Nov. 17, 2015

(54) DEVELOPER COLLECTION CONTAINER AND IMAGE FORMATION APPARATUS

(75) Inventor: Junichi Ushikubo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 71 days.

(21) Appl. No.: 13/302,139

(22) Filed: Nov. 22, 2011

(65) Prior Publication Data

US 2012/0128391 A1 May 24, 2012

(30) Foreign Application Priority Data

Nov. 22, 2010 (JP) ..... 2010-259731

(51) Int. Cl.

| | |
|---|---|
| ***G03G 15/08*** | (2006.01) |
| ***G03G 21/10*** | (2006.01) |
| ***G03G 21/12*** | (2006.01) |

(52) U.S. Cl.

CPC ..... *G03G 21/105* (2013.01); *G03G 21/12* (2013.01)

(58) Field of Classification Search

CPC ..... G03G 21/105; G03G 21/12; G03G 21/10

USPC ..... 399/98, 99, 120, 34, 35

See application file for complete search history.

(56) References Cited

U.S. PATENT DOCUMENTS

| | | | | |
|---|---|---|---|---|
| 2,209,707 | A * | 7/1940 | Shea | 222/233 |
| 2,800,252 | A * | 7/1957 | Wahl | 222/55 |
| 4,122,981 | A * | 10/1978 | Takeuchi et al. | 222/231 |
| 4,832,233 | A * | 5/1989 | Ichihara et al. | 222/201 |
| 4,974,025 | A * | 11/1990 | Kikuchi | 399/63 |
| 6,363,233 | B1 * | 3/2002 | Nakajima | 399/120 |
| 7,643,777 | B2 * | 1/2010 | Matsumoto et al. | 399/262 |
| 7,711,291 | B2 * | 5/2010 | Otani | 399/258 |
| 2006/0188302 | A1 * | 8/2006 | Stafford et al. | 399/358 |
| 2008/0317483 | A1 * | 12/2008 | Tanimoto et al. | 399/35 |
| 2010/0111582 | A1 * | 5/2010 | Nishimura et al. | 399/360 |

FOREIGN PATENT DOCUMENTS

| | | | |
|---|---|---|---|
| JP | 09-218627 | A | 8/1997 |
| JP | 2000-181224 | A | 6/2000 |
| JP | 2005-316351 | A | 11/2005 |
| JP | 2009-122238 | A | 6/2009 |
| JP | 2010-107901 | A | 5/2010 |
| JP | 2010-217574 | A | 9/2010 |

* cited by examiner

*Primary Examiner* — Clayton E Laballe
*Assistant Examiner* — Victor Verbitsky
(74) *Attorney, Agent, or Firm* — Marvin A. Motsenbocker; Mots Law, PLLC

(57) ABSTRACT

A developer collection container includes: a container body capable of containing collected developer; a developer conveyance member extending into the developer collection container and configured to convey the developer into the container body; and a guide provided in the container body and supporting the developer conveyance member from below the developer conveyance member.

26 Claims, 15 Drawing Sheets

DEVELOPER COLLECTION CONTAINER AND IMAGE FORMATION APPARATUS

CROSS REFERENCE TO RELATED APPLICATIONS

This application claims priority based on 35 USC 119 from prior Japanese Patent Application No. 2010-259731 filed on Nov. 22, 2010, entitled "DEVELOPER COLLECTION CONTAINER AND IMAGE FORMATION APPARATUS", the entire contents of which are incorporated herein by reference.

BACKGROUND OF THE INVENTION

1. Field of the Invention

The present disclosure relates to a developer collection container configured to collect unnecessary toner after use in an image formation apparatus such as an electrophotographic printer or copying machine which uses the toner as a developer, and relates to an image formation apparatus including the developer collection container.

An electrophotographic recording type of image formation apparatus is conventionally known which forms an image by fusing toner on a record medium, such as a sheet of paper. Such an image formation apparatus includes a photosensitive drum as an electrostatic latent image carrier. The image formation apparatus forms an image by performing the following processes. The photosensitive drum is charged and exposed to light to form an electrostatic latent image thereon. Then, toner is supplied to the electro static latent image formed on the photosensitive drum from a development roller to form a toner image on the photosensitive drum. A transfer unit transfers the toner image thus obtained to a record medium. Then, a fuse unit fuses the toner image on the record medium.

Japanese Patent Application Publication No. 2000-181224 describes a waste toner cartridge as a developer collection container. Residual toner remaining un-transferred on a photosensitive drum (hereinafter referred to as "waste toner") is scraped or cleaned off from the photosensitive drum by a cleaning blade. The scraped off waste toner is then conveyed to the waste toner cartridge that houses a spiral member configured to convey the held waste toner deep inside the cartridge.

SUMMARY OF THE INVENTION

An object of embodiments of the invention is to more efficiently convey developer deep inside a developer collection container.

A first aspect of the invention is a developer collection container that includes: a container body capable of containing collected developer; a developer conveyance member extending into the developer collection container and configured to convey the developer into the container body; and a guide provided in the container body and supporting the developer conveyance member from below the developer conveyance member.

A second aspect of the invention is an image formation apparatus that includes: a developer image carrier; a transfer unit configured to transfer the developer image formed on the developer image carrier to a record medium; a fusing unit configured to fuse the developer image transferred to the record medium; a cleaning device configured to remove the developer remaining on the developer image carrier; and the developer collection container of the first aspect configured to collect the removed developer.

According to the first aspect, the rotatable developer conveyance member conveys the waste toner from the outside to the inside of the container body. Thus, the waste toner can be conveyed into the container body with a simple configuration using a small number of parts. In the container body having the guide therein, the waste toner can freely fall from the guide and be deposited. Thus, the deposition progress in the downstream direction is improved. Accordingly, the waste toner can be efficiently contained in the container body.

According to the second aspect, the image formation apparatus includes the developer collection container of the first aspect, the image formation apparatus is capable of efficiently storing a large amount of the waste toner without increasing the size of the apparatus.

BRIEF DESCRIPTION OF THE DRAWINGS

FIGS. 7-1 to 7-5 are enlarged views showing guide 150 in FIG. 1.

FIGS. 8-1 to 8-3 are enlarged views showing guide 150 in FIG. 1.

FIGS. 14-1 to 14-5 are enlarged views showing guide 150A according to Embodiment 2 of the invention.

DETAILED DESCRIPTION OF EMBODIMENTS

Figure 1:
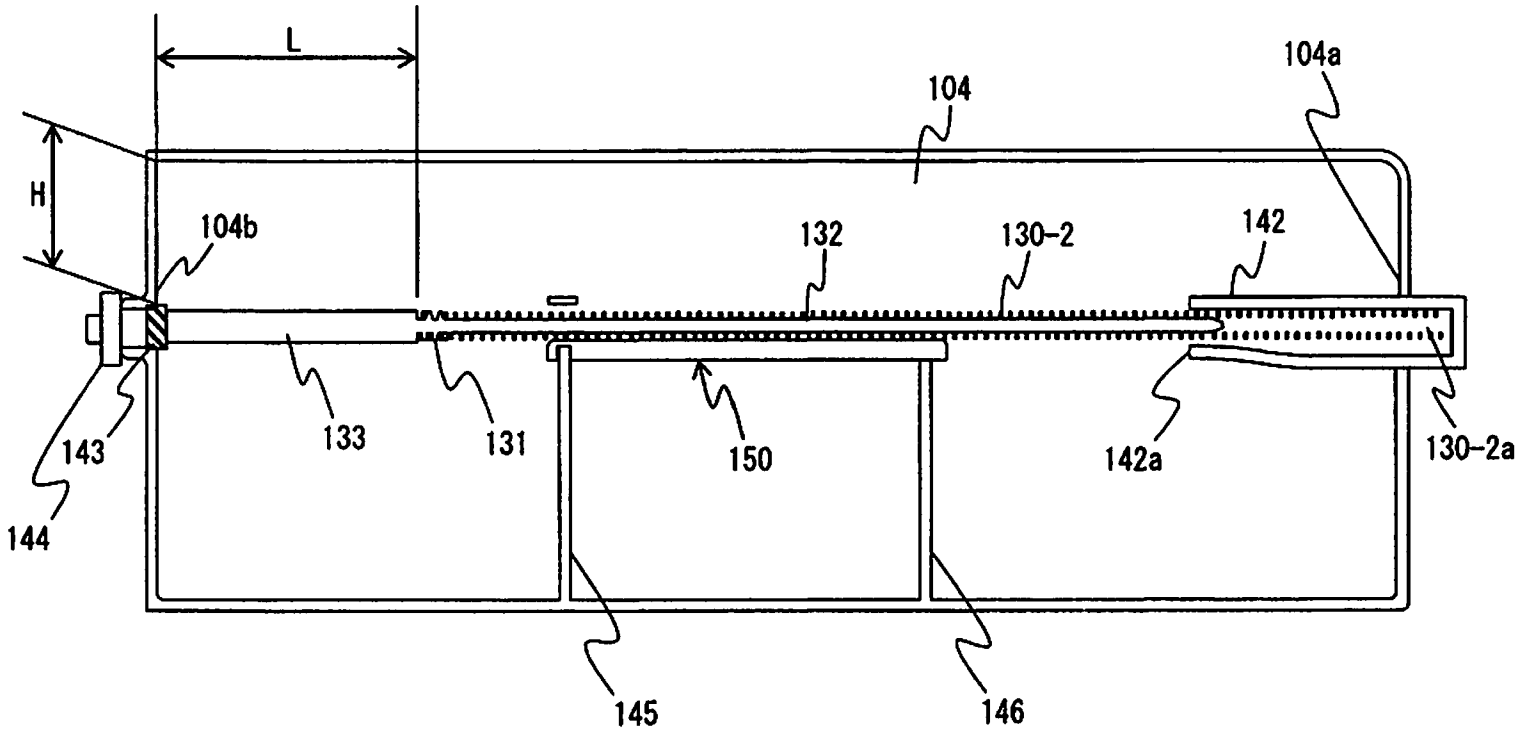
FIG. 1 is a view schematically showing toner collection container body 104 in FIG. 6 according to Embodiment 1 of the invention.

Descriptions are provided herein below for embodiments based on the drawings. In the respective drawings referenced herein, the same constituents are designated by the same reference numerals and duplicate explanation concerning the same constituents is omitted. All of the drawings are provided to illustrate the respective examples only.

Embodiment 1

Configuration of Embodiment 1

Figure 2:
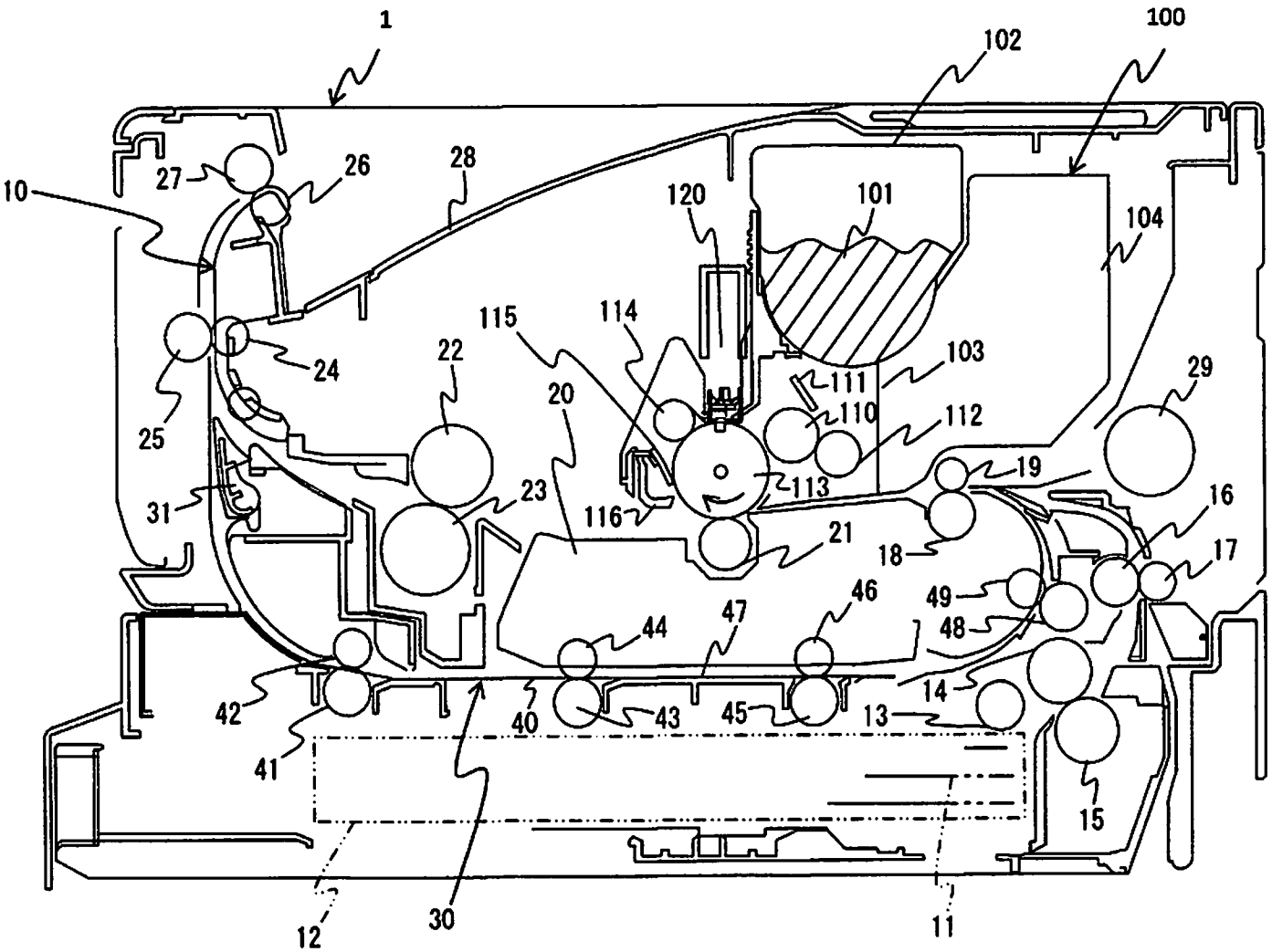
FIG. 2 is a view schematically showing a configuration of an image formation apparatus according to Embodiment 1 of the invention.

FIG. 2 is a view schematically showing a configuration of an image formation apparatus of Embodiment 1 of the invention.

Image formation apparatus 1 is, for example, an electrophotographic recording type of printer capable of duplex printing. Image formation apparatus 1 includes record medium conveyance path 10 for conveying record media such as record paper sheets in such a way that images are printed on front surfaces of the recording media, and record medium reverse conveyance path 30 for reversing and conveying the record media in such a way that images can be printed on back surfaces of the record media.

Record medium conveyance path 10 includes a path which starts at medium cassette 12, disposed in a lower portion of an inside of image formation apparatus 1 and configured to store record media 11, and which ends at medium stacker portion 28 formed in an upper portion of image formation apparatus 1 and configured to receive discharged record media 11. Between medium cassette 12 and medium stacker portion 28, the path passes through hopping roller 13 configured to feed out record media 11, feed roller 14 and retard roller 15 configured to separate fed-out record media 11 from each other one by one, conveyance roller 16 and pinch roller 17 configured to convey separated record media 11, conveyance roller 18 and pinch roller 19 configured to convey conveyed record media 11 toward transfer roller 21 in transfer unit 20, a fuse unit including fuse roller 22 and pressure roller 23 configured to fuse toner images transferred onto record media 11 by transfer unit 20, conveyance roller 24 and pinch roller 25 configured to convey record media 11 on which the toner images are fused by the fuse unit, and conveyance roller 26 and pinch roller 27 configured to discharge conveyed record media 11.

Moreover, manual feed roller 29, which is configured to receive manually-fed record media 11, is disposed near conveyance roller 18 and pinch roller 19.

Record medium reverse conveyance path 30 includes a path that includes reverse conveyance portion 40 and path switcher 31 disposed between a portion where fuse roller 22 and pressure roller 23 are arranged and a portion where conveyance roller 24 and pinch roller 25 are arranged. Path switcher 31 switches the conveyance direction of record media 11 from a direction to be sent to conveyance roller 24 and pinch roller 25 to a direction to be sent to reverse conveyance portion 40, and includes a path switch separator and the like. Reverse conveyance portion 40 includes multiple pairs of drive rollers 41, 43, 45 and driven rollers 42, 44, 46, multiple transmission belts 47, conveyance roller 48 and pinch roller 49 configured to reverse and convey record media 11 to conveyance roller 18 and pinch roller 19, and the like.

Image formation unit 100 is disposed on transfer unit 20. Image formation unit 100 includes toner cartridge 102 configured to store toner 101 as a developer, and toner collection container body 104 (or a developer collection container body) disposed on a lateral-surface side of toner cartridge 102 with partition plate 103 in-between. Toner collection container body 104 is configured to collect and accommodate waste toner. Development roller 110 is disposed as a developer carrier below toner cartridge 102. An outer circumferential surface of development roller 110 is in contact with layer formation blade 111 as a layer formation unit, toner supply roller 112 as a toner supply member, photosensitive drum 113 as an electrostatic latent image carrier and a developer image carrier.

An outer circumferential surface of photosensitive drum 113 is in contact with charge roller 114 configured to charge photosensitive drum 113, cleaning blade 115 as a cleaning device for photosensitive drum, and transfer roller 21 provided in transfer unit 20. Cleaning blade 115 is disposed in a downstream portion, in a rotation direction shown by the arrow in photosensitive drum 113, and is configured to scrape off the waste toner on photosensitive drum 113, and is made of, for example, polyurethane rubber. Housing 116 is configured to hold the scraped waste toner, and also to serve as a conveyance path for the waste toner as provided for below cleaning blade 115.

LED head 120 including multiple light emitting diodes (hereinafter, referred to as LED) as an exposure device is disposed near photosensitive drum 113.

Figure 3:
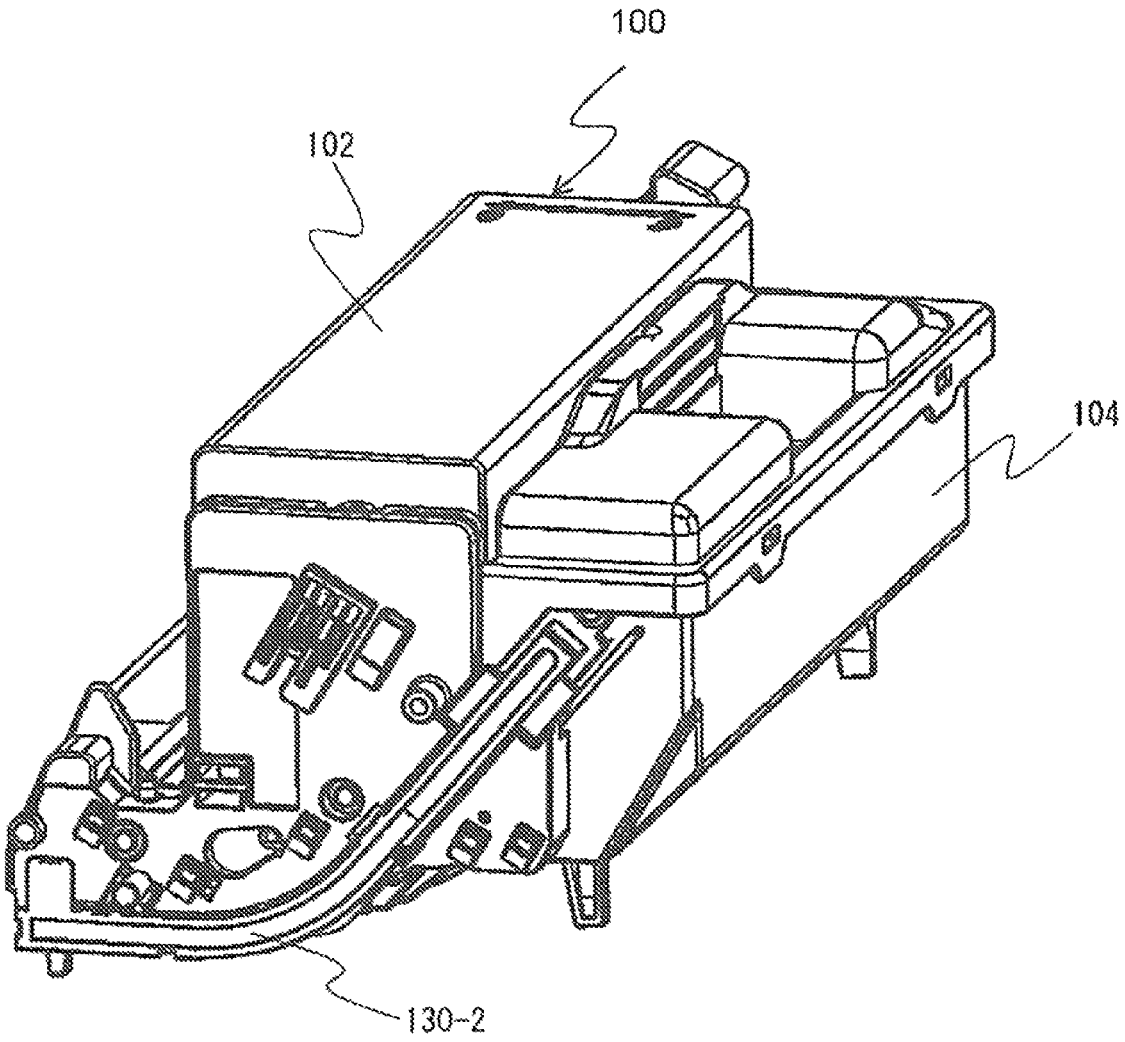
FIG. 3 is a view showing the exterior of image formation unit 100 in FIG. 2.
Figure 4:
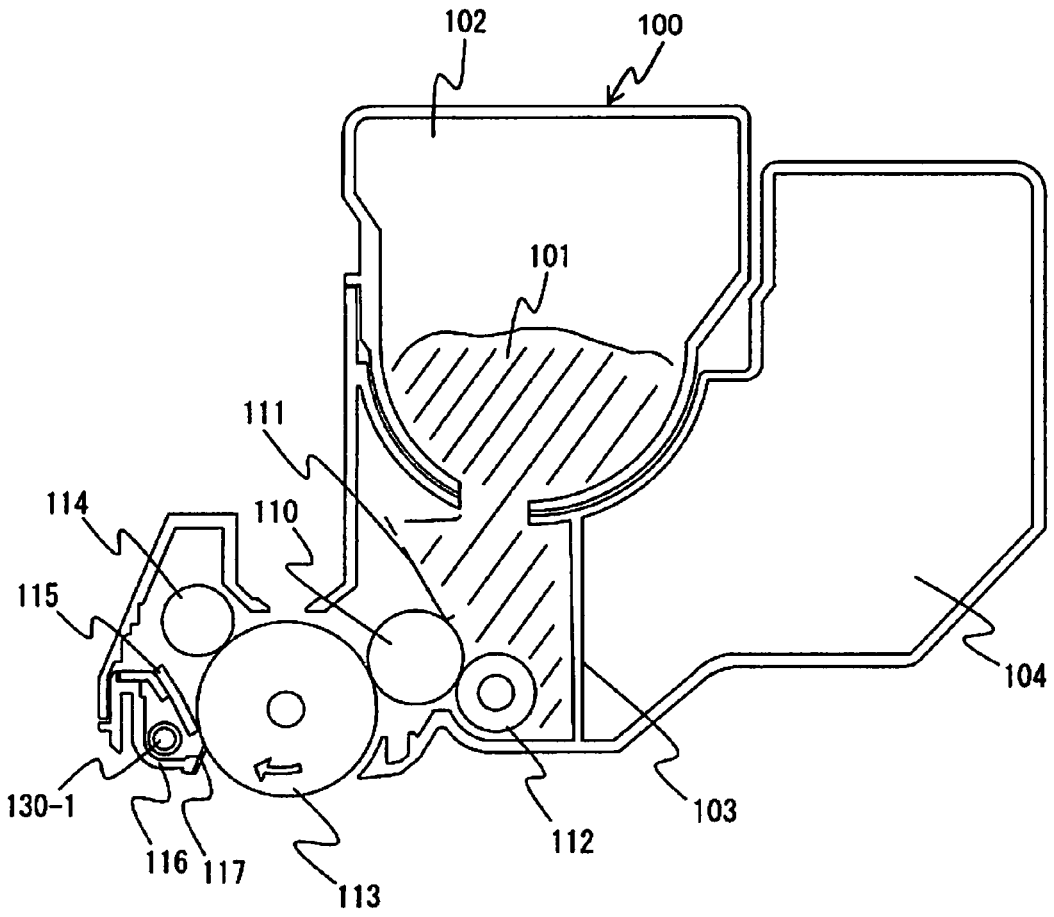
FIG. 4 is a view schematically showing the configuration of the inside of image formation unit 100 in FIG. 3.

FIG. 3 is a view showing the exterior of image formation unit 100 in FIG. 2. FIG. 4 is a view schematically showing a configuration of the inside of image formation unit 100 in FIG. 3.

For example, a developer described below is used as toner 101 stored in toner cartridge 102. The developer includes a polyester resin (glass transition temperature Tg=40° C.), a colorant, a charge control agent, and a mold release agent, and also an external additive (hydrophobic silica). Moreover, particles of the developer have a milled shape obtained by milling and an average particle size of 8 μm. Toner collection container body 104 is disposed on the lateral-surface side of the toner cartridge 102, is provided integrally in image formation unit 100, and is separated from toner cartridge 102 by partition plate 103.

One rotation conveyance member 130-1, among the two rotation conveyance members 130-1, 130-2 that form a developer conveyance member, is disposed below cleaning blade 115. Rotation conveyance member 130-1 is rotatably provided below and in parallel to cleaning blade 115. Rotation conveyance member 130-1 is configured to convey by rotation the waste toner removed by cleaning blade 115.

Housing 116 is disposed around rotation conveyance member 130-1. Rotation conveyance member 130-1 is rotatably supported by a side wall of housing 116 which is not illustrated, with a gap provided between rotation conveyance member 130-1 and photosensitive drum 113. Film 117 is attached to housing 116 by a double-sided tape or the like, and has a structure which closes a gap between photosensitive drum 113 and housing 116 to thereby prevent the waste toner from falling.

Figure 5:
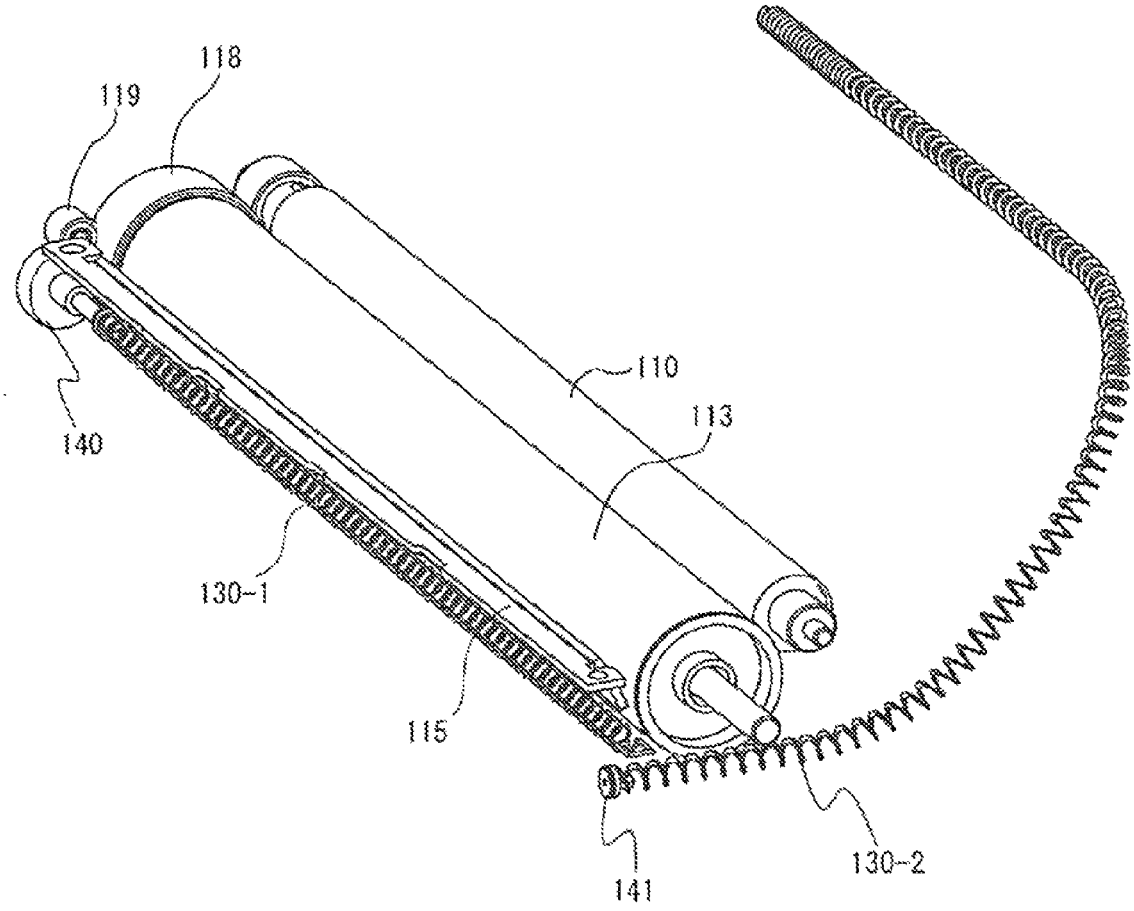
FIG. 5 is a view showing a configuration of rotation conveyance member 130-1 in FIG. 4 and its periphery in detail.

FIG. 5 is a view showing a configuration of rotation conveyance member 130-1 in FIG. 4 and its periphery in detail.

Rotation conveyance member 130-1 has, for example, a spiral coil shape obtained by winding stainless steel for a spring into a cylindrical shape, and gear 140 is provided at one end thereof. Gear 140 engages with drive gear 118 attached to photosensitive drum 113 via idle gear 119. Thus, rotation conveyance member 130-1 is configured to rotate in such a way that the rotation direction thereof is the same as that of photosensitive drum 113, and that the rotation speed thereof is in synchronization with the rotation speed of photosensitive drum 113.

In a near-side portion of FIG. 5, i.e. at the other end of rotation conveyance member 130-1*a* which is a downstream end thereof, the other rotation conveyance member 130-2 is disposed below, and orthogonal to, rotation conveyance member 130-1. Rotation conveyance member 130-2 has, for example, a spiral coil shape obtained by winding stainless steel for a spring into a cylindrical shape, and an upstream end thereof is rotatably supported. For example, resin cap 141 is attached to the upstream end of rotation conveyance member 130-2, and a metal end of rotation conveyance member 130-2 is thus configured not to be rubbed against peripheral units when rotating.

Figure 6:
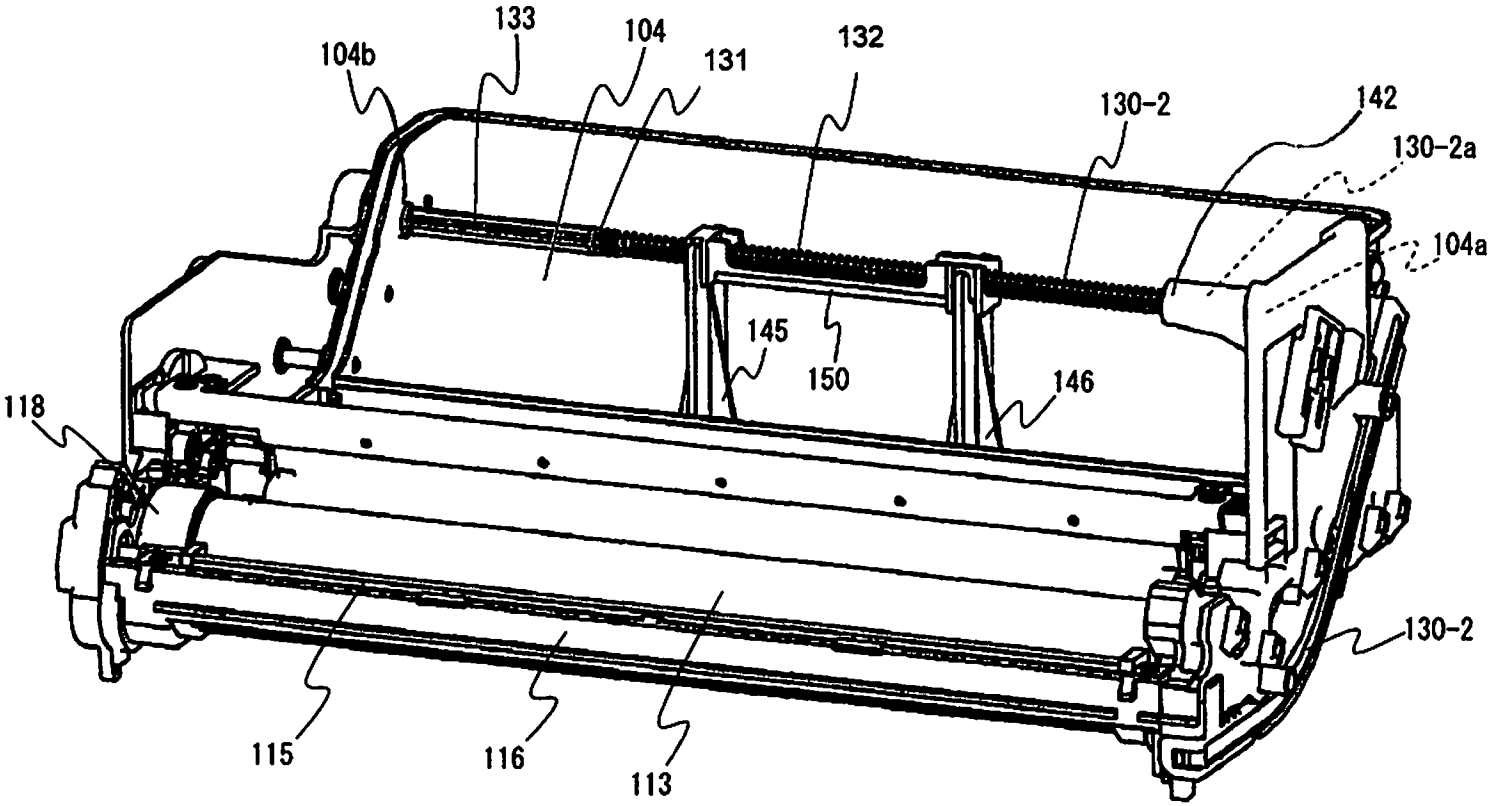
FIG. 6 is a view showing an arrangement of rotation conveyance member 130-2 in FIG. 5.

FIG. 6 is a view showing an arrangement of rotation conveyance member 130-2 in FIG. 5. FIG. 1 is a view schematically showing toner collection container body 104 in FIG. 6 of Embodiment 1 of the invention.

As shown in FIG. 6, rotation conveyance member 130-2 runs along a right end of the inside of image formation unit 100, and then extends from right end 104*a* to left end 104*b* in toner collection container body 109 provided in image formation unit 100. Rotation conveyance member 130-2 has a single spiral shape extending from a right lower end to a left upper end of image formation unit 100 shown in FIG. 6. Thus, an extending direction of rotation conveyance member 130-2 needs to be changed in a portion near right end 104*a* of toner collection container body 104. The portion where the extending direction is changed is referred to as curvature portion 130-2*a*. A curvature in curvature portion 130-2*a* is limited to a certain value depending on material strength and shape of rotation conveyance member 130-2. In Embodiment 1, rotation conveyance member 130-2 is a coil made of a steel material and having a diameter of 5.4 mm, and the curvature is set at a radius of 50 mm (R50).

As shown in FIGS. 1 and 6, housing 142 covers rotation conveyance member 130-2 in curvature portion 130-2*a* near right end 104*a* (i.e. upstream end) in toner collection container body 104, and thus run-out during the rotation is prevented. Opening 142*a* on the left side of housing 192 serves as an inlet from which the waste toner is introduced into toner collection container body 104. This inlet is coaxial with a rotation axis of rotation conveyance member 130-2 as the developer conveyance member. Rotation conveyance member 130-2 has spiral shape 132 through curvature portion 130-2*a* on the right side up to spiral coil end 131 on the left side, and has a columnar shape 133 that does not include spiral shape 132 from spiral coil end 131 to left end 104*b* (i.e. downstream end) of toner collection container body 104.

A setting is made to hold the relationship of L>H, where L is the length of columnar shape 133 and H is a distance from columnar shape 133 to the ceiling surface of toner collection container body 104.

Gear 144 is attached to a left end (i.e. downstream end) of rotation conveyance member 130-2 extending through seal member 143 attached to left end 104*b* of toner collection container body 104, on the outer side of toner collection container body 104. Seal member 143 is provided to prevent toner from leaking to the outside from a shaft portion of rotation conveyance member 130-2. Gear 144 is connected to a drive source via other gears not illustrated, and thus rotation conveyance member 130-2 is configured to be rotatable.

In FIG. 1, rotation conveyance member 130-2 is the steel material wound to a diameter of 5.4 mm. Thus, when rotation conveyance member 130-2 is disposed to extend from right end 104*a* to left end 104*b* of toner collection container body 104, a center portion thereof sags and thus cannot rotate. To counter this, toner collection container body 109 is provided with two ribs 145, 146 standing from a bottom surface thereof. Guide 150, made of a metal or a resin, is disposed in such a manner as to be suspended from ribs 145, 146. Guide 150 has an almost drainpipe shape. Guide 150 is not provided along the entire width from right end 104*a* to left end 104*b* of toner collection container body 104, but is provided only in a center portion. Guide 150 is not provided near the inlet for waste toner, which is opening 142*a* of housing 192 located on the right side.

A developer collection container of Embodiment 1 includes toner collection container body 104, rotation conveyance member 130-2 as the developer conveyance member, ribs 145, 146, and guide 150 as described above.

FIGS. 7-1 to 7-5 and FIGS. 8-1 to 8-3 are enlarged views showing guide 150 in FIG. 1.

Figures 1, 7:
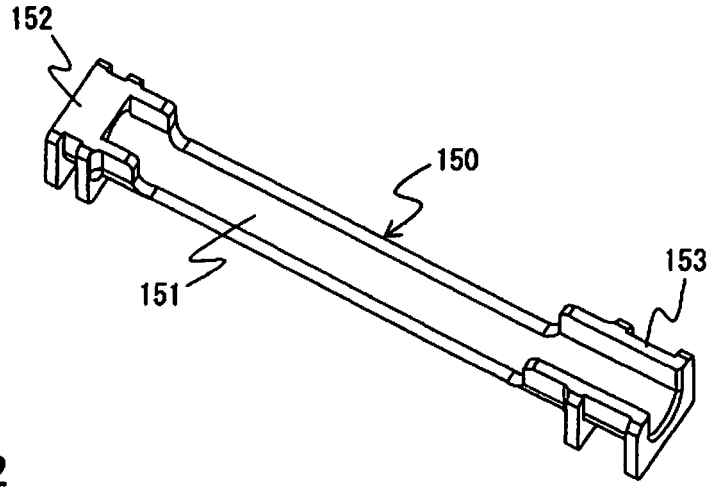
Figures 2, 7:
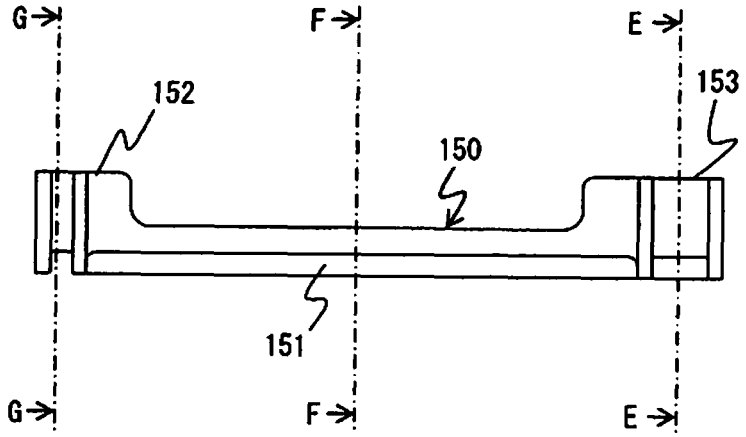
Figures 3, 7:
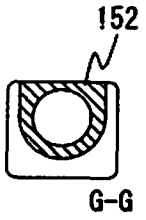
Figures 4, 7:
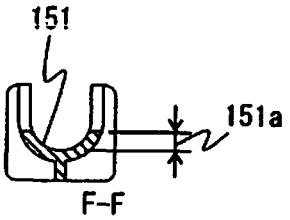
Figures 5, 7:
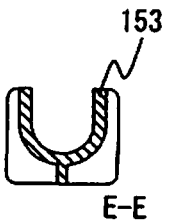

Among FIGS. 7-1 to 7-5, FIG. 7-1 is a perspective view of guide 150, FIG. 7-2 is front view of guide 150 in FIG. 7-1, FIG. 7-3 is a cross-sectional view taken along the line G-G in FIG. 7-2, FIG. 7-4 is a cross-sectional view taken along the line F-F in FIG. 7-2, and FIG. 7-5 is a cross-sectional view taken along the line E-E in FIG. 7-2. Among FIGS. 8-1 to 8-3, FIG. 8-1 is a perspective view of guide 150 supporting rotation conveyance member 130-2, FIG. 8-2 is a front view of guide 150 in FIG. 8-1, and FIG. 8-3 is a cross-sectional view taken along the line H-H in FIG. 8-2.

As shown in FIGS. 7-1 to 7-5 and FIGS. 8-1 to 8-3, guide 150 includes guide main body 151 which has an almost drainpipe shape and whose cross-sectional shape in a direction orthogonal to the longitudinal direction is an arc shape. One guide end portion 152 (or a hold portion) and the other guide end portion 153 (or a hold portion) each have a shape capable of holding (for example, a shape covering) rotation conveyance member 130-2, and are configured to prevent run-out from occurring when rotation conveyance member 130-2 rotates. Specifically, one guide end portion 152 has a ring-shaped cross section, and the other guide end portion 153 has an almost U-shaped cross section. As shown in FIG. 7-4, guide main body 151 is set such that height 151*a* of a wall whose cross section has an arc shaped is smaller than the cross-sectional diameter of rotation conveyance member 130-2. In Embodiment 1, the diameter of rotation conveyance member 130-2 is set at 5.4 mm and height 151*a* is set at 1.5 mm.

Figures 1, 8:
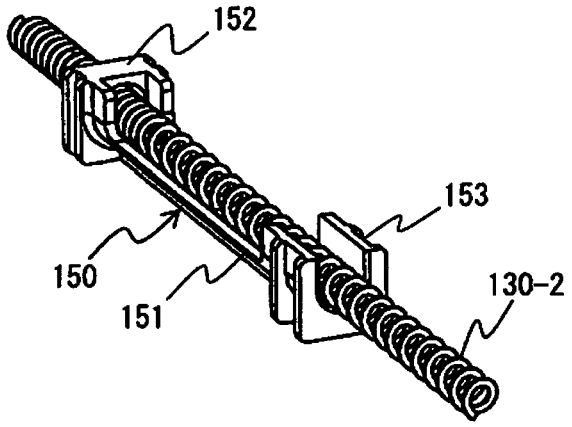
Figures 2, 8:
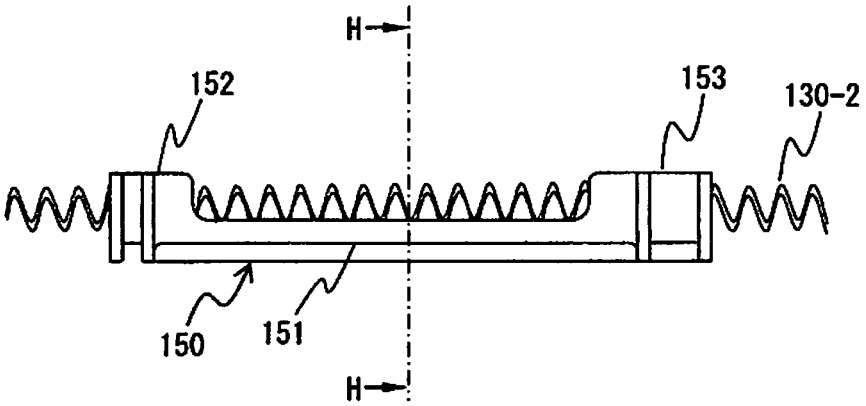
Figures 3, 8:
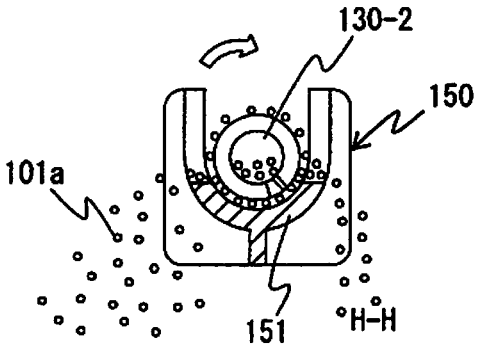

FIG. 8-3 shows a state where waste toner 101*a* scatters around when rotation conveyance member 130-2 rotates on guide main body 151.

Operation of the Entire Image Formation Apparatus of Embodiment 1

In FIG. 2, when a print operation of image formation apparatus 1 is started, a control by a controller (not illustrated) causes hopping roller 13, feed roller 14, retard roller 15, and conveyance rollers 16 and 18 to rotate. Thus, hopping roller 13 feeds out record media 11 in medium cassette 12, and feed roller 14 and retard roller 15 separate the fed-out record medium 11 from each other, one by one. Conveyance roller 16 and pinch roller 17, as well as conveyance roller 18 and pinch roller 19, convey each of separated record medium 11 to a position below image formation unit 100.

A control by the controller causes photosensitive drum 113, charge roller 114, transfer roller 21, fuse roller 22, development roller 110, and conveyance rollers 24 and 26 to rotate. Moreover, the control causes voltages to be applied to charge roller 114, development roller 110, toner supply roller 112, layer formation blade 111, and transfer roller 21. Furthermore, the control causes pressure roller 23 to press fuse roller 22, and the temperature of fuse roller 22 is thereby adjusted.

Thereafter, a control by the controller causes LED head 120 to be driven in a way such that the surface of photosensitive drum 113 is irradiated with light corresponding to an image signal, and an electrostatic latent image is thereby formed in a portion of photosensitive drum 113 which has been uniformly charged by charge roller 114. Photosensitive drum 113 with the electrostatic latent image formed on the surface thereof continues to rotate, and the electrostatic latent image thus comes into contact with development roller 110. Toner 101, supplied from toner supply roller 112 onto development roller 110, is charged. Upon coming into contact with photosensitive drum 113, charged toner 101 adheres to the electrostatic latent image by electrostatic effect and the electrostatic latent image is developed. Thus, a toner image is formed on photosensitive drum 113.

The surface of photosensitive drum 113 on which the toner image is formed comes into contact with transfer roller 21. Transfer roller 21 is in contact with photosensitive drum 113 at a predetermined pressure. Transfer roller 21 is charged and the toner image on photosensitive drum 113 is transferred to record medium 11. Record medium 11, onto which the image has been transferred, is inserted between fuse roller 22 and pressure roller 23 by conveyance roller 18 and pinch roller 19, and the toner image on record medium 11 is fused. After the fusing is completed, conveyance roller 24 and pinch roller 25, as well as conveyance roller 26 and pinch roller 27, discharge record medium 11 as a printed material to medium stacker portion 28 on the outer side.

In a case of duplex printing, a control by the controller causes path switcher 31 to operate. Moreover, the control causes drive roller 41, 43, 45, driven rollers 42, 44, 46, transmission belts 47, conveyance roller 48, and pinch roller 49 in reverse conveyance portion 40 to rotate.

When path switcher 31 operates, record medium 11, on which an image is fused by fuse roller 22 and pressure roller 23, is sent to reverse conveyance portion 40 to be turned over, and then conveyed to a portion between conveyance roller 18 and pinch roller 19. Thereafter, as in the aforementioned case, printing is performed on the back surface of record medium 11 by image formation unit 100, transfer roller 21, fuse roller 22, pressure roller 23, and the like, and record medium 11 is discharged to medium stacker portion 28 on the outer side.

Operation of Waste Toner Collection in Embodiment 1

In FIGS. 3 and 4, part of the development toner on the surface of photosensitive drum 113 remains as waste toner 101*a* after the transfer to record medium 11 is completed. However, photosensitive drum 113 continues to rotate, and waste toner 101*a* comes into contact with cleaning blade 115 and is scraped off from photosensitive drum 113 by an edge portion of cleaning blade 115. Waste toner 101*a* scraped off is conveyed downstream by the rotation of rotation conveyance member 130-1 rotating at a speed synchronized with photosensitive drum 113.

In FIGS. 1, 5 and 6, rotation conveyance member 130-2 is rotated by a drive from gear 144 attached to left end 104*b* of toner collection container body 104 of FIG. 1. Waste toner 101*a* is sent by rotation conveyance member 130-1 to the end portion thereof, falls on rotation conveyance member 130-2, and is conveyed further downstream by rotation conveyance member 130-2.

FIGS. 9, 10, 11, 12, and 13 are views respectively showing deposition states (1) to (5) of waste toner 101*a* in toner collection container body 104 of FIG. 1. Note that, illustrations of ribs 145, 146 supporting guide 150 are omitted in FIGS. 9 to 13 for convenience in providing the description.

Figure 9:
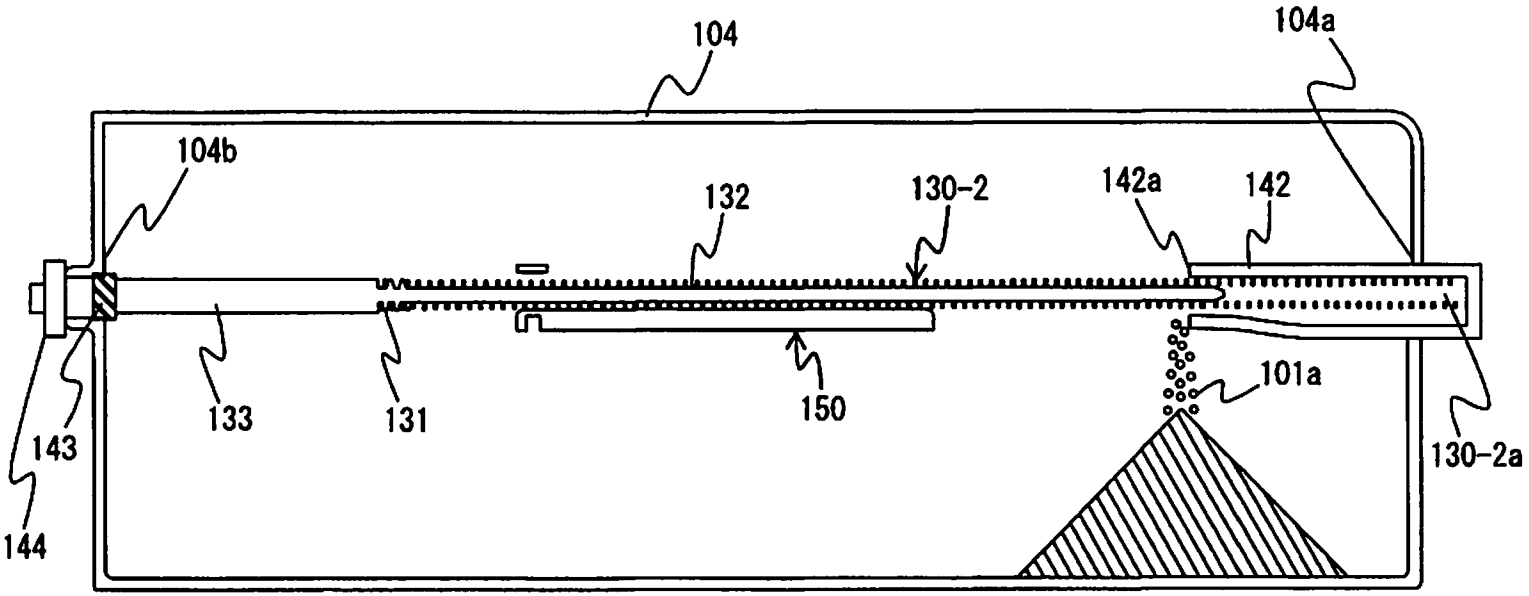
FIG. 9 is a view showing a deposition state (1) of waste toner 101*a* in toner collection container body 104 of FIG. 1.

In the deposition state (1) of FIG. 9, toner collection container body 104 is provided in a downstream region of rotation conveyance member 130-2. Waste toner 101*a*, having reached opening 142*a* of housing 142 which is the inlet of toner collection container body 104, falls freely and is deposited in toner collection container body 104.

Figure 10:
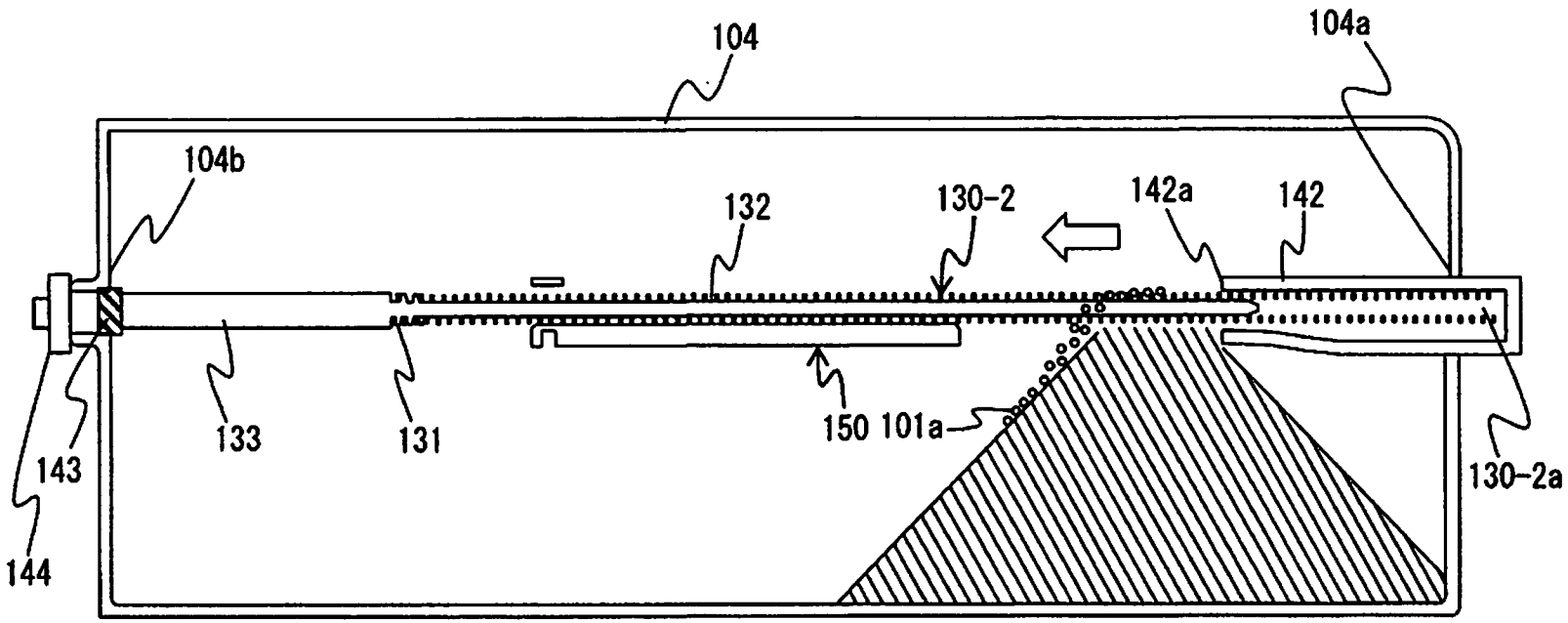
FIG. 10 is a view showing a deposition state (2) of waste toner 101*a* in toner collection container body 104 of FIG. 1.

In the deposition state (2) of FIG. 10, when an apex portion of waste toner 101*a* reaches a height position of rotation conveyance member 130-2, the rotation of rotation conveyance member 130-2 causes the apex portion of waste toner 101*a* to be pushed downstream, as shown by the arrow in FIG. 10. Thus, the deposition of waste toner 101*a* progresses in a downstream direction. When the deposition of waste toner 101*a* progresses and reaches an end of guide 150, waste toner 101*a* cannot fall freely to a region directly below rotation conveyance member 130-2, and is thus conveyed inside guide 150.

Figure 11:
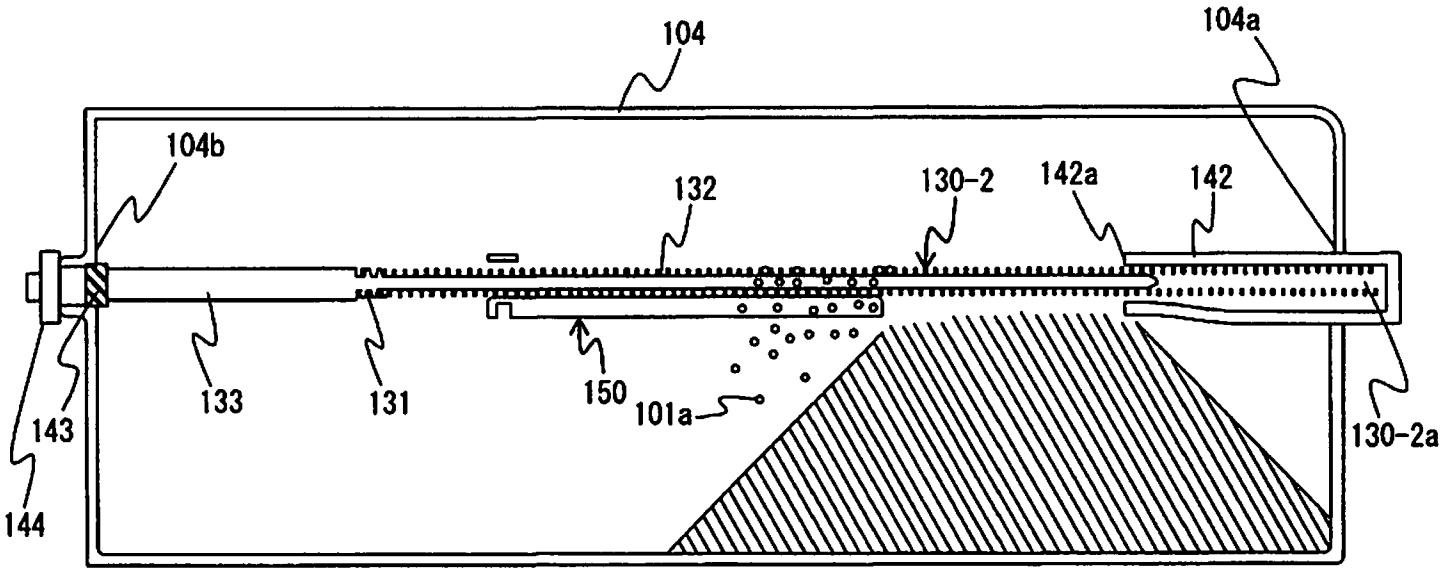
FIG. 11 is a view showing a deposition state (3) of waste toner 101*a* in toner collection container body 104 of FIG. 1.

In the deposition state (3) of FIG. 11, height 151*a* of the wall of guide main body 151 is set at 1.5 mm with respect to the diameter of rotation conveyance member 130-2 which is 5.4 mm as shown in FIG. 7-4. Thus, as shown in FIG. 8-3, when rotation conveyance member 130-2 rotates in the direction of the arrow, waste toner 101*a* conveyed in guide main body 151 is scattered by the centrifugal force of the rotation. The scattered waste toner 101*a* falls to the outside of guide main body 151. Hence, the effects of guide 150 are minimized, and the deposition of waste toner 101*a* progresses in the downstream direction.

Here, if height 151*a* of the wall of guide main body 151 is larger than half of 5.4 mm (=2.7 mm) which is the diameter of rotation conveyance member 130-2, scattered waste toner 101*a* does not fly over the wall and fall below guide main body 151. On the contrary, if height 151*a* of the wall is 1 mm or smaller, the wall cannot exhibit the effect of a guide preventing rotation conveyance member 130-2 from meandering. Accordingly, good results in terms of the deposition of waste toner 101*a* can be obtained by setting height 151*a* of the wall of guide main body 151 within a range of ¼ to ⅓ of the diameter of rotation conveyance member 130-2.

Figure 12:
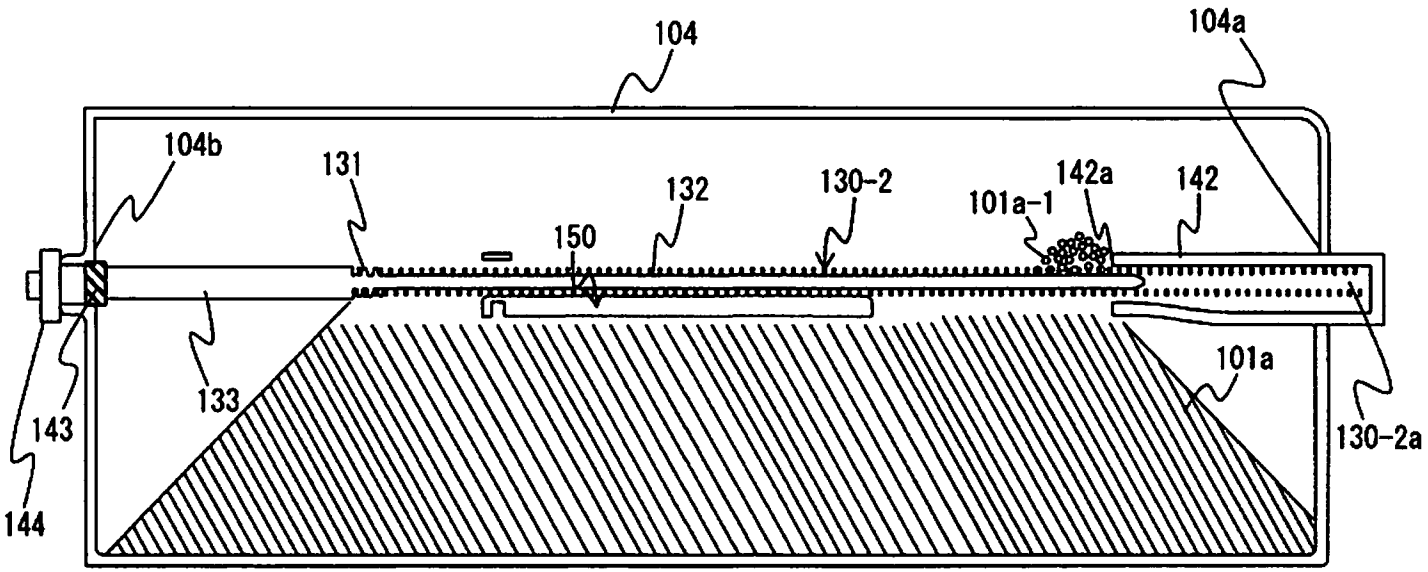
FIG. 12 is a view showing a deposition state (4) of waste toner 101*a* in toner collection container body 104 of FIG. 1.

In the deposition state (4) of FIG. 12, when the deposition of waste toner 101*a* reaches spiral coil end 131 of rotation conveyance member 130-2, spiral shape 132 cannot convey waste toner 101*a* further downstream. However, since waste toner 101*a* is continuously conveyed by rotation conveyance member 130-2, conveyed waste toner 101*a* is pushed against deposited waste toner 101*a*. As a result, waste toner 101*a* is deposited (101*a*-1) upward against gravitational force. First, waste toner 101*a* is deposited (101*a*-1) in a region close to opening 142*a* of housing 142, which is the inlet of toner collection container body 104, and is then gradually deposited in a region downstream thereof. Thereafter, waste toner 101*a* reaches a region above guide main body 151. Since guide main body 151 does not cover an upper surface of rotation conveyance member 130-2, the deposition in the upward direction is also not interrupted in this region.

Figure 13:
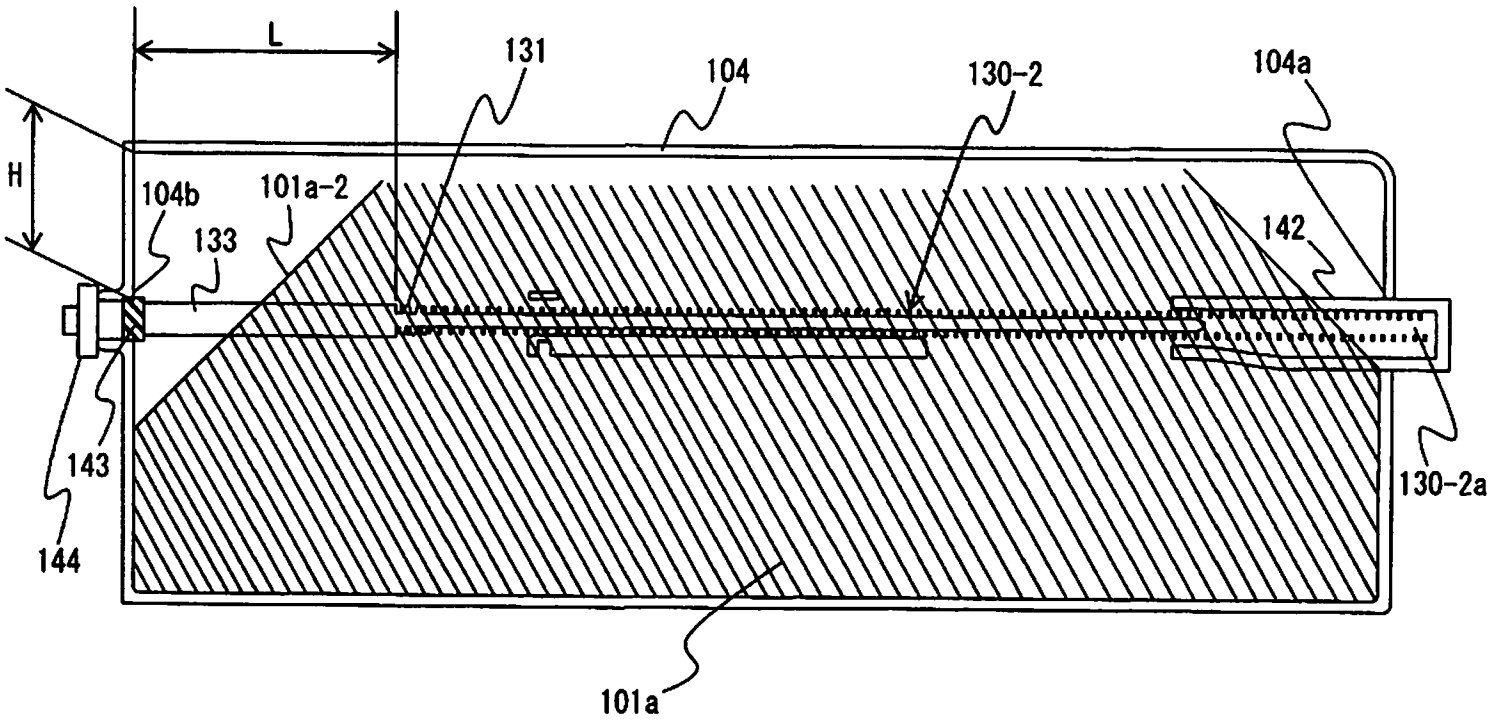
FIG. 13 is a view showing a deposition state (5) of waste toner 101*a* in toner collection container body 104 of FIG. 1.

In the deposition state (5) of FIG. 13, waste toner 101*a* is deposited (101*a*-2) to a region close to a left upper end of toner collection container body 104. In the deposition state (5), the deposition of waste toner 101*a* (101*a*-2) does not reach seal member 143 of rotation conveyance member 130-2. This is because the relationship between length L of columnar shape 133 in rotation conveyance member 130-2 and distance H from columnar shape 133 to the ceiling surface of toner collection container body 104 is set to be L>H. Accordingly, a large amount of waste toner 101*a* can be held with a small risk of toner leaking from the rotation shaft portion in seal member 143.

Effects of Embodiment 1

Embodiment 1 has the following effects of the next paragraphs (a) to (d).

(a) Rotation conveyance member 130-2 conveys waste toner 101*a* from the outside to the inside of toner collection container body 104. Thus, waste toner 101*a* can be conveyed into toner collection container body 109 with a simple configuration using a small number of parts.

(b) The deposition of waste toner 101*a* starts in the region close to opening 142*a* of housing 142 which is the inlet, and progresses in the downstream direction in toner collection container body 104. Waste toner 101*a* can fall from guide main body 151 and be deposited also in a center portion of toner collection container body 104 where guide 150 is provided. Thus, there is no change in the situation in which the deposition progresses in the downstream direction. Accordingly, waste toner 101*a* can be efficiently held in toner collection container body 104.

(c) Waste toner 101*a* is less likely to enter the rotation shaft portion of rotation conveyance member 130-2 in seal member 143 until waste toner 101*a* fully fills toner collection container body 104. Thus, toner leakage is less likely to occur.

(d) An image formation apparatus capable of efficiently containing a large amount of waste toner 101*a* can be achieved without increasing the size of the apparatus, by including a developer collection container having the effects described in paragraphs (a) to (c).

Embodiment 2

Configuration of Embodiment 2

In a developer collection container of Embodiment 2 of the invention, a configuration of a guide included therein has a configuration different from guide 150 of Embodiment 1. Thus, only the different points are described.

Figures 1, 14:
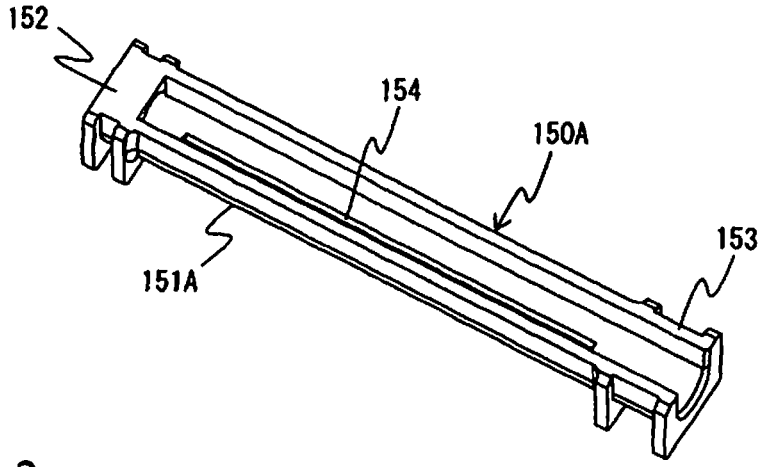
Figures 2, 14:
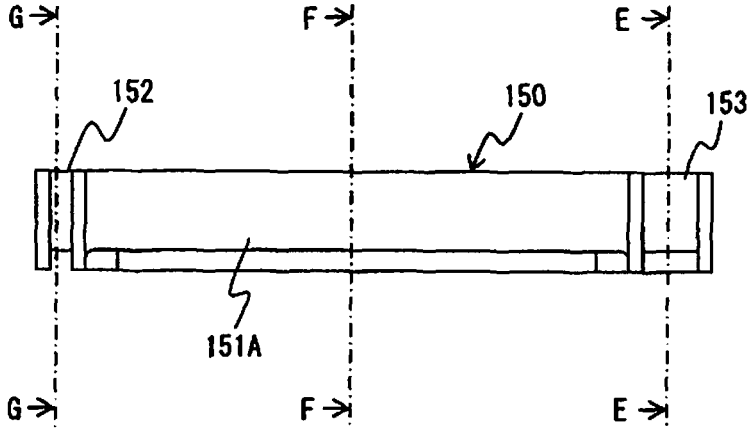
Figures 3, 14:
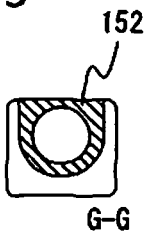
Figures 4, 14:
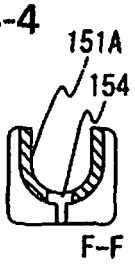
Figures 5, 14:
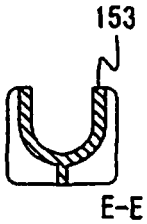

FIGS. 14-1 to 14-5 are enlarged views showing guide 150A of Embodiment 2 of the invention. FIG. 14-1 is a perspective view of guide 150A, FIG. 14-2 is a front view of guide 150A in FIG. 14-1, FIG. 14-3 is a cross-sectional view taken along the line G-G in FIG. 19-2, FIG. 14-4 is a cross-sectional view taken along the line F-F in FIG. 14-2, and FIG. 14-5 is a cross-sectional view take along the line E-E in FIG. 14-2.

In FIGS. 14-1 to 14-5, elements which are the same as those in FIGS. 7-1 to 7-5 showing Embodiment 1 are denoted with the same reference numerals.

Guide 150A includes guide main body 151A which has an almost drainpipe shape and whose cross-sectional shape in a direction orthogonal to a longitudinal direction is a substantially U-shape. Guide main body 151A has a shape covering rotation conveyance member 130-2. Furthermore, one guide end portion 152 (a hold portion) and the other guide end portion 153 (a hold portion) have shapes capable of holding (for example, a shape covering) rotation conveyance member 130-2. Specifically, one guide end portion 152 has a ring-shaped cross section, and other guide end portion 153 has a U-shaped cross section as in Embodiment 1. Guide main body 151A and guide end portions 152 and 153, which are described above, prevent run-out of rotation conveyance member 130-2 from occurring during the rotation thereof.

Slit hole 154, extending in a longitudinal direction of guide main body 151A, is formed in a bottom portion of a center portion of guide main body 151A in the longitudinal direction.

The width of slit hole 154 is set at 3 mm, for example. Walls are provided respectively in portions on both sides of slit hole 154 to support rotation conveyance member 130-2. Other configurations are the same as those of Embodiment 1.

Operation of Embodiment 2

Figure 15:
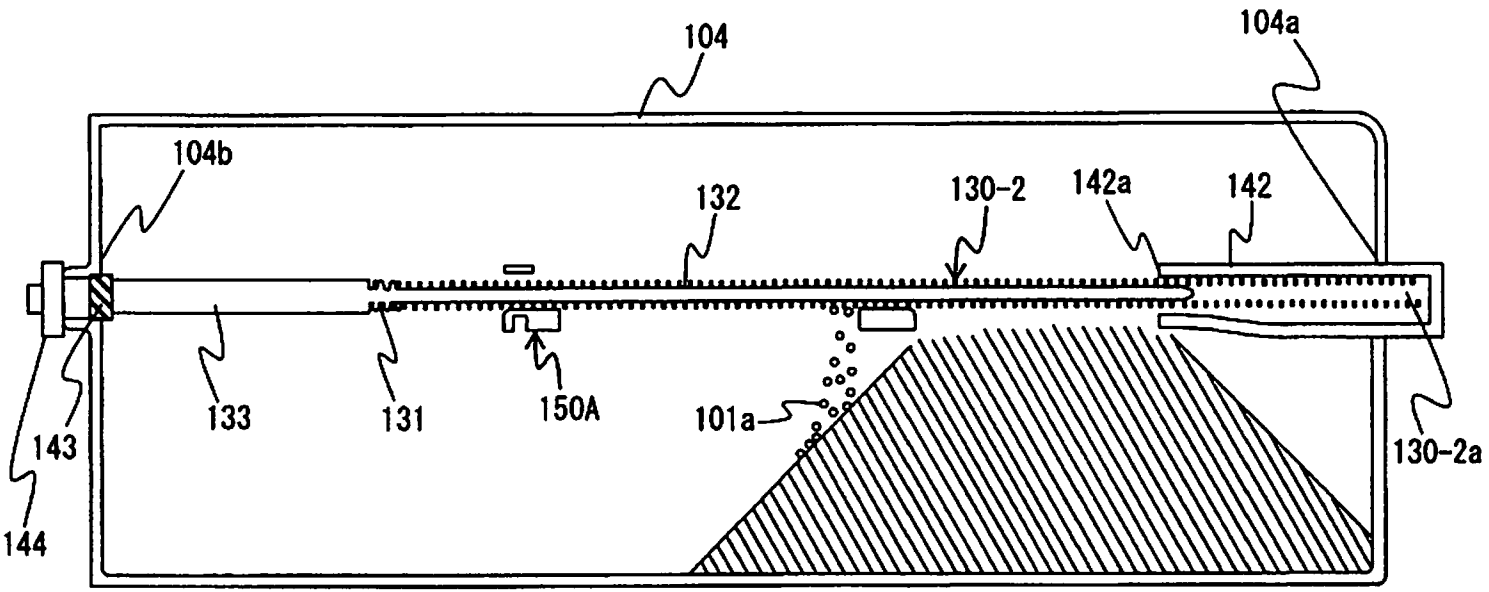
FIG. 15 is a view showing a deposition state of waste toner 101*a* in toner collection container body 104 including guide 150A of FIG. 14.

FIG. 15 is a view showing a deposition state of waste toner 101*a* in toner collection container body 104 including guide 150A of FIGS. 14-1 to 14-5. Note that, in FIG. 15, illustrations of ribs 145, 146 in FIG. 6 which support guide 150A are omitted for convenience in providing the description.

In FIG. 15, waste toner 101*a* conveyed onto guide 150A by the rotation of rotation conveyance member 130-2 freely falls from the center portion of guide main body 151A, i.e. from slit hole 154 provided directly below rotation conveyance member 130-2, and is deposited. In a state where waste toner 101*a* is sufficiently deposited below rotation conveyance member 130-2 and no longer freely falls, the deposition progresses upward as in Embodiment 1. Here, since guide main body 151A does not have a wall in an upper portion thereof, the deposition in the upward direction is not interrupted. Moreover, the walls in both-sides portions of guide 150A cover side surfaces of rotation conveyance member 130-2. Thus, rotation conveyance member 130-2 does not run out during the rotation, and meandering thereof can be prevented.

Effects of Embodiment 2

Embodiment 2 has almost the same effects as Embodiment 1. In addition, since slit hole 154 is formed in the bottom surface of guide 150A and the high walls are provided in both side portions of guide 150A, run-out and meandering of rotation conveyance member 130-2 during the rotation can be surely prevented in an entire region extending in the longitudinal direction of guide 150A.

Modified Example

The invention is not limited to Embodiments 1 and 2 described above, and various utilization modes and modifications are allowed. Examples of such utilization modes and modifications include paragraphs (i) to (iii) described below.

(i) Configurations of image formation apparatus 1, image formation unit 100, and the like may be changed to configurations other than those illustrated in the drawings.

(ii) The developer collection containers of Embodiments 1 and 2 can be applied to other image formation apparatuses other than the printer, such as a facsimile apparatus, a copier, and a multifunction printer (MFP).

(iii) In an image formation apparatus having a structure in which a developer image on a photosensitive drum (first developer carrier) is transferred to an intermediate transfer belt, and then the developer image on the intermediate transfer belt is transferred to a record medium, wasted toner may be collected from the intermediate transfer belt.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A developer collection container comprising:

a container body configured to contain collected developer and having an upstream side wall and a downstream side wall with respect to a developer conveyance direction;

a tubular projection extending inwardly from the upstream side wall of the container body toward a center portion of the container body, the tubular projection having, at a downstream end of the tubular projection, inlet opening from which the developer is introduced into the container body;

first and second ribs provided within the container body and extending upward from a bottom surface of the container body;

a developer conveyance member extending into the developer collection container and configured to convey the developer into the container body, the developer conveyance member including a spiral portion configured to convey, in the developer conveyance direction along a longitudinal direction of the developer conveyance member, the developer that is introduced into the container body via the inlet opening such that a part of the developer conveyance member is covered by the tubular projection; and a guide provided in the container body and supporting the developer conveyance member from below the developer conveyance member, wherein the guide is provided only at an intermediate area of the container body with respect to the developer conveyance direction, the intermediate area provided between the inlet opening and a downstream end of the spiral portion in the developer conveyance direction and in which the guide extends from a position away from the inlet opening in the developer conveyance direction, wherein the guide is fixed to and supported by the first and second ribs such that first and second longitudinal ends of the guide are respectively supported from below the guide by the first and second ribs, and wherein the guide is formed in a U-shape with an upper opening at an upstream end thereof and with a ring shape at a downstream end thereof with respect to the developer conveyance direction.

2. The developer collection container according to claim 1, wherein the guide is made of one of a resin and a metal.

3. The developer collection container according to claim 1, wherein the guide extends in the longitudinal direction of the developer conveyance member and is provided only in a central region of the container body with respect to the longitudinal direction of the container body.

4. The developer collection container according to claim 1, wherein the guide includes a guide main body extending in the longitudinal direction of the developer conveyance member and covering the developer conveyance member at least from below the developer conveyance member, and an upper end of each widthwise side of the guide main body is located within a range of ¼ to ⅓ of a height of the developer conveyance member.

5. The developer collection container according to claim 1, wherein the guide includes:

a guide main body extending in the longitudinal direction of the developer conveyance member and covering the developer conveyance member at least from below the developer conveyance member; and a hold portion provided at a part of the guide main body in the longitudinal direction and extending to a position higher than the guide main body on each widthwise side of the developer conveyance member but not entirely covering a top of the developer conveyance member.

6. The developer collection container according to claim 1, wherein the guide includes:

a guide main body extending in the longitudinal direction of the developer conveyance member and covering the developer conveyance member at least from below the developer conveyance member; and a hold portion provided at a part of the guide main body in the longitudinal direction and extending to a position higher than the developer conveyance member on each widthwise side of the developer conveyance member but not entirely covering a top of the developer conveyance member.

7. The developer collection container according to claim 6, wherein the hold portion has a substantially U-shaped cross section in the direction orthogonal to the longitudinal direction of the guide.

8. The developer collection container according to claim 6, wherein the hold portion has an annular-shaped cross section in the direction orthogonal to the longitudinal direction of the guide.

9. The developer collection container according to claim 6, wherein a gap is provided between the guide and the downstream end of the container body in the longitudinal direction of the developer conveyance member.

10. The developer collection container according to claim 1, wherein the developer conveyance member includes the rotatable spiral portion configured to convey the developer along with rotation.

11. The developer collection container according to claim 10, wherein the spiral portion of the developer conveyance member extends from an upstream side in the developer collection container to a nearly downstream end inside the developer collection container.

12. The developer collection container according to claim 1, wherein the developer conveyance member is rotatably supported in a region upstream of the container body.

13. The developer collection container according to claim 1, wherein the inlet opening is coaxial with a rotation axis of the developer conveyance member.

14. The developer collection container according to claim 1, wherein the guide includes a guide main body extending in the longitudinal direction of the developer conveyance member and covering the developer conveyance member at least from below the developer conveyance member, wherein the guide main body has a single rectangular-shaped slit hole in a bottom portion of the guide main body and extending along a longitudinal direction of the guide main body from a first position adjacent to a first side of the guide main body closest to the upstream end of the container body to a second position adjacent to a second side of the guide main body closest to the downstream end of the container body.

15. The developer collection container according to claim 14, wherein the slit hole does not extend onto each widthwise wall of the guide main body but instead is only disposed on a bottom surface of the guide main body.

16. An image formation apparatus comprising:

a developer image carrier;

a transfer unit configured to transfer a developer image formed on the developer image carrier to a record medium;

a fusing unit configured to fuse the developer image transferred to the record medium;

a cleaning device configured to remove developer remaining on the developer image carrier after the transfer; and the developer collection container of claim 1 configured to collect the removed developer.

17. The developer collection container according to claim 1, wherein the guide main body forms a U-shaped channel for guiding the developer and for conveying the developer therealong.

18. The developer collection container according to claim 1, wherein the guide main body further comprises:

a first end portion that has higher widthwise walls than widthwise walls provided on a central portion of the guide main body; and a second end portion that has higher widthwise walls than the widthwise walls provided on the central portion of the guide main body.

19. The developer collection container according to claim 1, wherein the guide is spaced apart from both the upstream end and the downstream end of the container body in the developer conveyance direction.

20. The developer collection container according to claim 1, wherein the guide has a round cross-sectional shape at one of the longitudinal ends and has an arc cross-sectional shape at an area closer to the other longitudinal end than the one longitudinal end of the guide, and wherein a height of each widthwise wall of an intermediate area of the guide is lower than a height of each widthwise wall of the other longitudinal end of the guide.

21. The developer collection container according to claim 20, wherein the developer conveyance member comprises a wire rod having a coil shape.

22. The developer collection container according to claim 21, wherein the inlet opening is coaxially provided with respect to a rotation axis of the developer conveyance member.

23. The developer collection container according to claim 1, wherein the guide is spaced apart from the upstream end by at least a distance corresponding to a length of the guide main body, and wherein the guide is spaced apart from the downstream end by at least the distance corresponding to the length of the guide main body.

24. A developer collection container comprising:

a container body configured to contain collected developer and includes an upstream side wall and a downstream side wall with respect to a developer conveyance direction, wherein the upstream side wall includes a tubular projection projecting from the upstream side wall toward a position within an interior of the container body;

a developer conveyance member extending into the developer collection container through the tubular projection and configured to convey the developer into the container body; and a guide provided in the container body and supporting the developer conveyance member from below the developer conveyance member, the guide including: a guide main body extending in a longitudinal direction of the developer conveyance member and formed in a U-shape with an upper opening; and a ring-shape support portion at a downstream end portion of the guide main body with respect to the developer conveyance direction, wherein the guide main body has a single rectangular-shaped slit hole in a bottom surface of a U-shaped center region of the guide main body that faces the developer conveyance member, in which the slit hole extends along a longitudinal direction of the guide main body, wherein the slit hole extends from a first position adjacent to a first side of the guide main body closest to an upstream end of the container body to a second position adjacent to a second side of the guide main body closest to a downstream end of the container body, wherein a part of the developer conveyance member is rotatably supported by the tubular projection and another part of the developer conveyance member is rotatably supported by the ring-shape support portion of the guide.

25. The developer collection container according to claim 24, wherein the single rectangular-shaped slit hole does not extend onto each widthwise wall of the guide main body, and wherein the single rectangular-shaped slit hole is only disposed on the bottom surface of U-shaped center region of the guide main body.

26. The developer collection container according to claim 24, wherein the developer conveyance member includes a spiral portion configured to convey, in the developer conveyance direction along the longitudinal direction of the developer conveyance member, the developer that is introduced into the container body via an inlet opening from an upstream end in the container body where the inlet opening is provided, toward a downstream end of the container body which is opposite to the upstream end, and wherein the guide is provided between the inlet opening and a downstream end of the spiral portion in the developer conveyance direction and extends from a position away from the inlet opening in the developer conveyance direction.

* * * * *